United States Patent [19]

Leiblich

[11] 3,962,900

[45] June 15, 1976

[54] FENCE DROPPER AND METHOD OF PRODUCTION

[76] Inventor: Gordon Francis Leiblich, Kimba, Australia, 5641

[22] Filed: Jan. 3, 1975

[21] Appl. No.: 538,367

Related U.S. Application Data

[62] Division of Ser. No. 361,993, May 21, 1973, Pat. No. 3,865,349.

[30] Foreign Application Priority Data

May 23, 1972 Australia ..... 9049/72

[52] U.S. Cl. ..... 72/379; 72/324; 29/415

[51] Int. Cl.[2] ..... B21C 37/02

[58] Field of Search ..... 29/415; 72/329–331, 72/334, 335, 337, 324, 379; 113/116 V, 116 Y, 116 BB; 256/10, 35, 37, 38; 83/32, 46

[56] References Cited

UNITED STATES PATENTS

| | | | |
|---|---|---|---|
| 841,798 | 1/1907 | Mac Murray | 83/32 |
| 1,142,001 | 6/1915 | Whitney | 72/337 X |
| 2,631,804 | 3/1953 | Uhlhorn | 256/47 X |
| 3,461,708 | 8/1969 | Pepe | 72/337 X |

FOREIGN PATENTS OR APPLICATIONS

| | | | |
|---|---|---|---|
| 1,443,375 | 5/1966 | France | 256/47 |
| 342,636 | 2/1931 | United Kingdom | 72/332 |

*Primary Examiner*—Carl E. Hall
*Assistant Examiner*—D. M. Gurley
*Attorney, Agent, or Firm*—Jay L. Chaskin

[57] ABSTRACT

A fence dropper which may be used as a spacer or a post and which is suitable for supporting the wires of a wire fence, the fence dropper being provided with a series of tongues each of which is joined to but spaced from one edge of the body portion by a root. Each tongue is provided with a forwardly extending portion and a return portion which constitute with the body of the dropper a wire retaining aperture, but since the tongues are spaced from the dropper by their roots, the tongues form with the dropper edge slots in a plane which is at right angles to a fence, the arrangement then being such that a dropper may be positioned against a fence with wires in respective slots and rotated through 90° whereupon the wires become contained within the wire retaining recesses.

6 Claims, 9 Drawing Figures

FENCE DROPPER AND METHOD OF PRODUCTION

This is a division of application Ser. No. 361,993, filed May 21, 1973, now U.S. Pat. No. 3,865,349.

This invention relates to a fence dropper which is useful for retaining the wires of fences in spaced relationship, and to the method of production of such a fence dropper, (the word "dropper" including a spacer or a post).

BACKGROUND OF THE INVENTION

There are several types of fence droppers in use. One type of fence dropper is of pressed metal and is provided with a plurality of centrally located tongues which selectively engage the wires of a fence, and are deformed upon positioning of the dropper, this type of dropper usually having its lower end positioned in the ground. These droppers do not have high strength, and are slow to position because of the deforming operations. A second type of dropper which is used is a timber dropper wherein the wires of a fence are secured by means of staples or by means of tie wires, but these tend to split upon aging and are also slow to position. Furthermore they are easily broken by stock. A third type of fence dropper which is in use is a wire type, but although the wire type is quickly and easily positioned, it is insufficiently rigid to resist bending.

MAIN OBJECTS OF THE INVENTION

The main objects of this invention are to provide a fence dropper which is of low cost, which may be formed to have ample strength in a plane at right angles to the plane of a fence which it supports without the use of excessive material, and which is quickly and easily positioned onto or removed from fence wires.

BRIEF SUMMARY OF THE INVENTION

In this invention a fence dropper is provided with a series of tongues each of which is joined to but spaced from one edge of the body portion by a root. Each tongue is provided with a forwardly extending portion and a return portion, and the dropper when viewed in side elevation will be seen to have a wire retaining aperture extending across the plane of a fence delineated partly by the tongue and partly by the body portion, but when the dropper is viewed in front elevation there is no wire retaining aperture. In lieu thereof there is a slot delineated by the edge of each tongue, its root and an adjacent edge of the body portion. This then enables the dropper to be positioned adjacent a fence with the wires in respective slots, and rotated by 90° to retain the wires. The dropper may be tied in place to one of the wires, and if desired, have its lower end driven into the ground.

More specifically, the invention consists of a fence dropper having a body portion arranged to extend rearwardly away from the plane of a fence when supported by the dropper to have a higher moment of inertia at right angles to said plane than parallel with said plane, a plurality of tongues spaced from one another along one edge of the body portion, each tongue having as its root a bridge portion joining it to but spacing it from said body portion edge and extending forwardly of said plane from said root, said tongue further having a return portion which terminates rearwardly of said plane to thereby define with said body portion a wire retaining aperture extending across said plane of the fence.

With some of the previously proposed fence droppers, tongues have been pierced from the outer edges but the punchings constituted a loss of effective metal. In order to obtain maximum economy in the forming of fence droppers, further according to this invention a strip of metal for the forming of two fence droppers is sheared in such a way as to form complementary tongues and tongue forming recesses which are all of identical shape and size. There are then no punchings and therefore a maximum economy can be achieved. The shearing operation can take place either before or after the forming operation.

Figure 1:
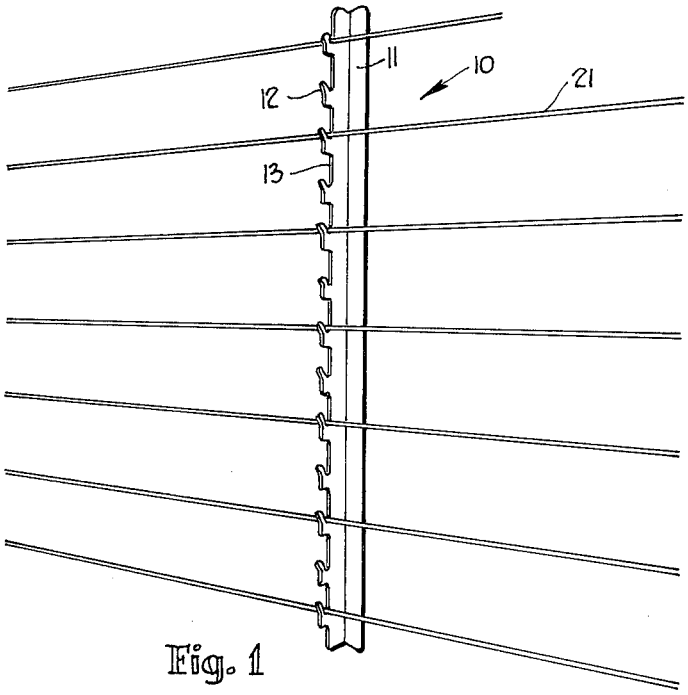
FIG. 1 is a perspective view of a fence dropper used as a post and supporting a wire fence.

In the first embodiment a fence dropper 10 is formed with a body portion 11 and a series of tongues 12 extending along one edge 13, the fence dropper being of constant thickness and formed from sheet metal. The body portion 11 is non-planar in cross section and includes a curved "U" shaped portion as seen best in FIGS. 5 and 8 which provides stiffness against buckling. One edge of the curved portion terminates in an outstanding flange 15 opposite but co-planar with edge 13 having the series of spaced tongues 12.

Figure 2:
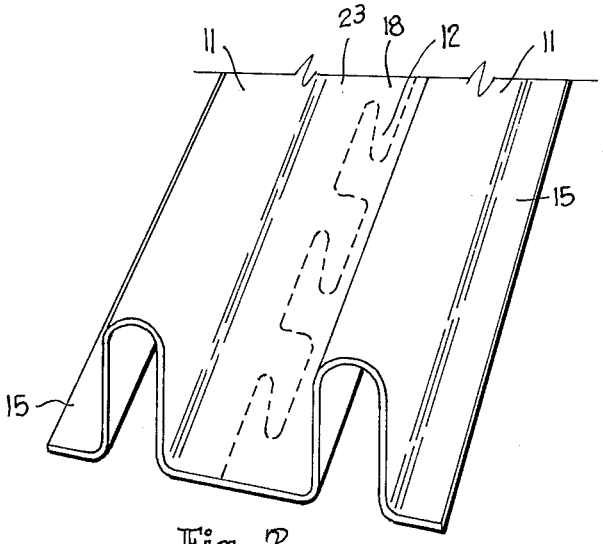
FIG. 2 is a fragmentary perspective view of a pair of fence droppers joined together by a flange, the dotted lines representing the shear line between the droppers.
Figure 3:
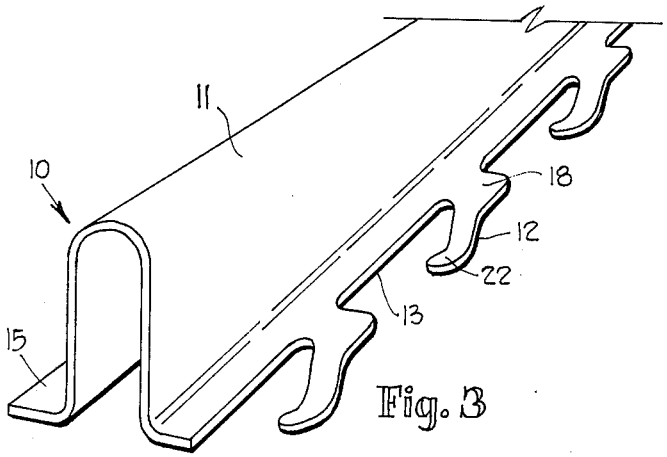
FIG. 3 is a fragmentary perspective view showing a dropper fully formed.
Figure 4:
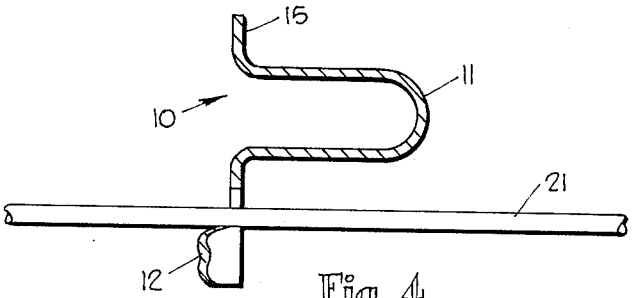
FIG. 4 is a plan view showing a post positioned on a fence with a wire in a slot between a tongue and an edge of the dropper.

Each tongue 12 itself has a small bridge portion 18 which functions as the root of the tongue joining the tongue 12 to the edge 13 of the body portion 11 of the dropper, each tongue extending from the flange portion in a direction which is parallel to the longitudinal axis of the dropper. However, when viewed in side elevation (FIG. 6) the tongue 12 is formed forwardly from the plane of the fence 21, the tongue having a return portion 22 so that it defines with the body portion an aperture 20 but this aperture exists only when viewed in side elevation. The tongue is displaced from the edge of the body portion by a distance which is equal to its own width at any one point (FIG. 2), the shape of the recess and the shape of the tongue being identical so that a single shearing operation between two fence droppers produced simultaneously results in the formation of the tongues and recesses of each.

In this embodiment the fence dropper 10 is produced by a method of firstly forming a strip of sheet metal to have a pair of formed body portions 11 extending parallel to one another and each comprising a longitudinal axis of a body portion of a fence dropper, the two body portions being joined together by a bridging web 23 which is subsequently sheared to form tongues and recesses in both portions, each tongue of one dropper being complementary in shape to the recess of the other. Since maximum strength is required in the plane at right angles to the plane of the fence, the body portion 11 is formed to provide a higher moment of inertia in the plane at right angles to the plane of the fence than in the plane of the fence.

Figure 5:
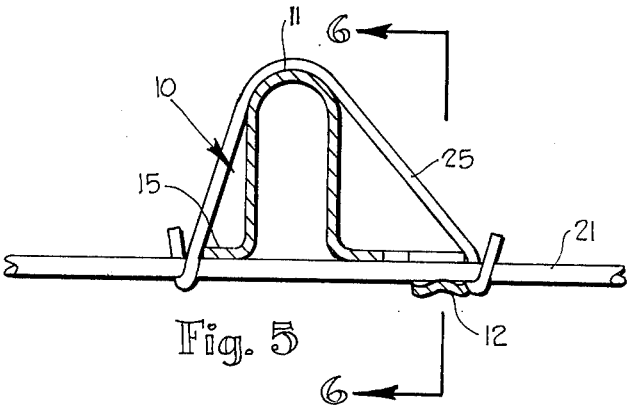
FIG. 5 is a corresponding view showing the dropper rotated so as to support the wire, and tied in place.
Figure 6:
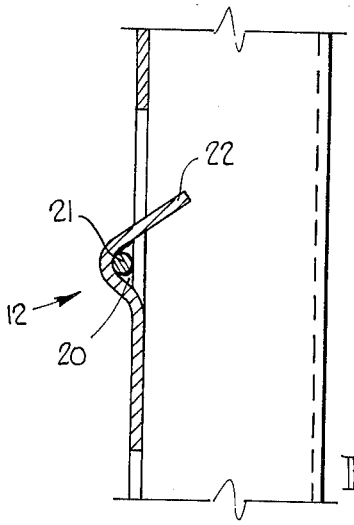
FIG. 6 is an enlarged section on line 6—6 of FIG. 5.

The assembly of a fence dropper of this invention on a fence is simply achieved by presenting the edge 13 of the fence dropper 10 having the tongues to one side of the wires of the fence, the wires being in the slots between the tongues 12 and edge 13, and rotating the fence dropper to lie parallel with the fence, the wires of the fence then being accommodated in the apertures formed between the tongue and the body portion in the side elevation as shown in FIG. 6, and the dropper then being wired to a fence wire by a tie wire 25 (FIG. 5). The sole function of the tie wire which wires the dropper to the fence is to prevent rotation and the wire does not function as a load bearing member under normal usage.

The dropper of this invention may also be used as a frame member for a structure having grid-like panels.

A brief consideration of the above embodiments will indicate that the invention makes possible an inexpensive and effective fence dropper which is easily positioned on the wires of a fence. It will be appreciated that variations such as the inclusion of a slotted flange on the edge opposite the tongues, changes of the cross sectional shape of the body portion of the dropper, and certain changes in the configuration of the tongues can lie within the scope of the invention.

Figure 9:
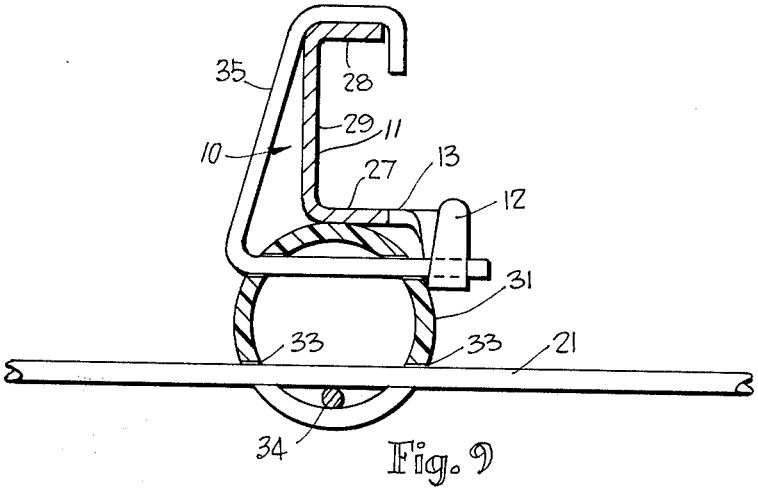
FIG. 9 is a sectional view of a dropper according to a second embodiment, but otherwise similar to FIG. 8.

For example in the second embodiment of FIG. 9, the dropper 10 is formed to a channel shape, the edge 13 being one edge of a flange 27, there being a flange 28 parallel thereto, and a web 29 joining the flanges 27 and 28, the flanges and web between them forming the body portion 11. In this embodiment two blanks are sheared with the tongue profiles, and the body portions subsequently formed.

Figure 7:
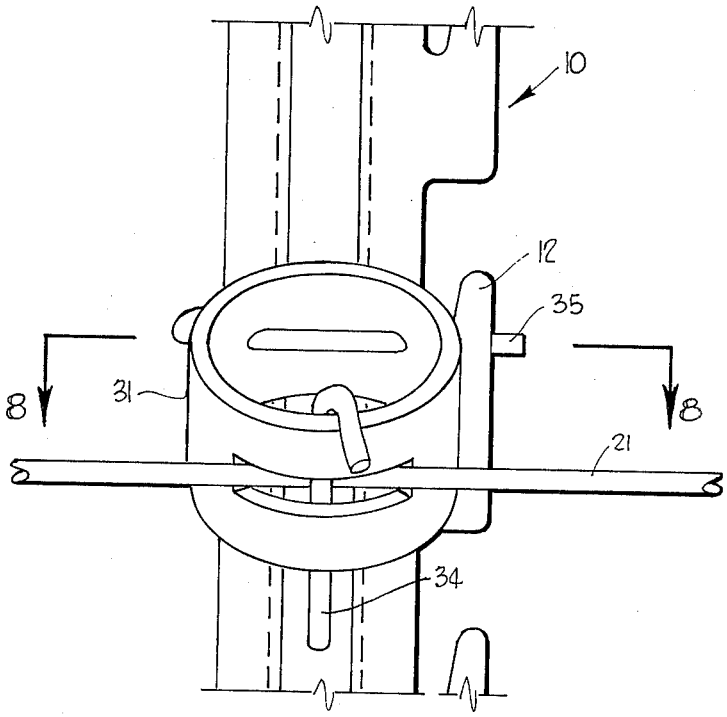
FIG. 7 is a perspective view showing the manner in which the dropper supports an insulator for a wire to which an electric potential is to be applied.
Figure 8:
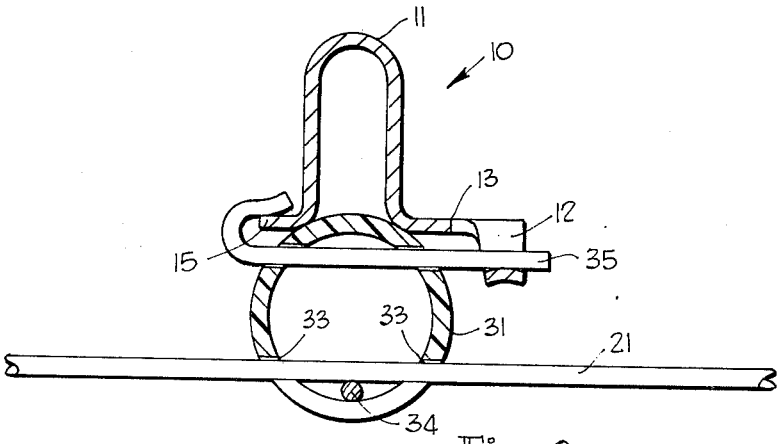
FIG. 8 is a section taken on line 8—8 of FIG. 7.

As shown in FIGS. 7, 8 and 9, the invention is simply adapted to the support of a wire to which an electric potential is to be applied. A short length of thermoplastics (P.V.C.) tube 31 is secured to one face of the dropper 10 by a tie wire 35 which engages a tongue 12, the fence wire 21 being locked in a slot 33 by a locking pin 34. The tube 31 functions as an insulator.

In both embodiments the tongues are blanked but not formed in the end of a dropper which is to be driven into the ground. That end is of tapered shape, having a sharp point. The flanges and tongues may be stiffened by means of ribs formed into them if this is required.

While there has been described what is at present considered to be a preferred embodiment of this invention, it will be obvious to those skilled in the art that various changes and modifications may be made therein without departing from the invention, and it is, therefore, aimed to cover all such changes and modifications as fall within the true spirit and scope of the invention as presented by the appended claims.

What is claimed is:

1. A method of forming a fence dropper having a body portion with a plurality of tongues spaced from one another and lying beyond one edge thereof, comprising forming a sheet metal blank into two said body portions of similar cross-sectional shape which extend away from a plane and are joined together by a flat bridging web which lies in that plane, shearing the flat bridging web to simultaneously blank the profiles of said tongues in their flat form, and respective webs joining the roots of the tongues to the body portions such that each tongue is of similar size and shape, and the recess formed between a said tongue and the body portion from which it is spaced by said root and also between that said tongue and an adjacent said tongue has its size and shape similar to the tongue size and shape, and then forming each said flat tongue to provide therein a return portion which extends forwardly of but terminates rearwardly of said plane to thereby define with said body portion a wire retaining aperture.

2. A method of forming a fence dropper according to claim 1 wherein each said body portion is formed to a 'U' shaped cross-section and is flanked by a respective flange also lying in said plane, each said recess extending only partway across said bridging web, whereby the 'U' shaped body portion of each fence dropper is flanked on both sides by flanges, and said tongues extend from one only of the two flanges.

3. A method of forming a fence dropper according to claim 1 wherein the body portion is formed to a "U"-shaped cross-section.

4. A method of forming a fence dropper according to claim 1 wherein each tongue is of identical size and shape.

5. A method of forming a fence dropper according to claim 1 wherein the shearing forms two fence dropper body portions, each body portion having a plurality of tongues.

6. A method of forming a fence dropper according to claim 5 wherein each tongue is of identical size and shape.

* * * * *